US010068686B2

(12) United States Patent
Kumada

(10) Patent No.: US 10,068,686 B2
(45) Date of Patent: Sep. 4, 2018

(54) COAXIAL CABLE

(71) Applicant: Yazaki Corporation, Minato-ku, Tokyo (JP)

(72) Inventor: Taketo Kumada, Susono (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/732,112

(22) Filed: Jun. 5, 2015

(65) Prior Publication Data

US 2015/0270032 A1 Sep. 24, 2015

Related U.S. Application Data

(63) Continuation of application No. PCT/JP2013/082190, filed on Nov. 29, 2013.

(30) Foreign Application Priority Data

Dec. 7, 2012 (JP) ..... 2012-268213

(51) Int. Cl.
*H01B 7/36* (2006.01)
*H01B 11/18* (2006.01)
*H01B 7/02* (2006.01)

(52) U.S. Cl.
CPC ..... *H01B 11/1895* (2013.01); *H01B 7/0225* (2013.01); *H01B 7/361* (2013.01); *H01B 11/1839* (2013.01)

(58) Field of Classification Search
CPC ..... H01B 7/36
USPC ..... 174/28, 112
See application file for complete search history.

(56) References Cited

U.S. PATENT DOCUMENTS 3,551,586 A * 12/1970 Dembiak ..... H01B 9/022 156/714
4,808,966 A * 2/1989 Ferlier ..... B44B 7/002 219/121.68
6,207,902 B1 * 3/2001 Balaguer ..... H01B 7/361 174/112
6,246,006 B1 6/2001 Hardin et al.
7,084,343 B1 * 8/2006 Visser ..... C09D 167/00 174/102 R (Continued)

FOREIGN PATENT DOCUMENTS

CN 1299512 A 6/2001
CN 1421965 A 6/2003

(Continued)

OTHER PUBLICATIONS

Jan. 7, 2014—(WO) Written Opinion of ISA—Intl App PCT/JP2013/082190.

(Continued)

*Primary Examiner* — Chau N Nguyen
(74) *Attorney, Agent, or Firm* — Banner & Witcoff, Ltd.

(57) ABSTRACT

A coaxial cable includes an internal conductor, an insulator that is provided at an outer circumference of the internal conductor, a film that is provided at an outer circumference of the insulator, an external conductor that is provided at an outer circumference of the film, a sheath that is provided at an outer circumference of the external conductor, and an adhesive layer that is provided between the insulator and the film and that bonds the insulator and the film with each other.

1 Claim, 3 Drawing Sheets

(56) References Cited

U.S. PATENT DOCUMENTS

| | | | | |
|---|---|---|---|---|
| 7,468,489 | B2 * | 12/2008 | Alrutz | H01B 7/366 174/112 |
| 2014/0027149 | A1 | 1/2014 | Shimizu et al. | |

FOREIGN PATENT DOCUMENTS

| | | | |
|---|---|---|---|
| JP | S60-118817 | U | 8/1985 |
| JP | H08-298027 | A | 11/1996 |
| JP | 2002-513988 | A | 5/2002 |
| JP | 2008-269990 | A | 11/2008 |
| JP | 2012-119231 | A | 6/2012 |
| JP | 2012-138285 | A | 7/2012 |
| WO | 9957735 | A1 | 11/1999 |
| WO | 2012/137850 | A1 | 10/2012 |

OTHER PUBLICATIONS

Jan 7, 2014—International Search Report—Intl App PCT/JP2013/082190.
Feb. 1, 2016—(CN) The First Office Action—App 201380064132.4.
Sep. 7, 2016—(JP) Notification of Reasons for Refusal—App 2012-268213.
Jul. 19, 2016—(CN) Notification of the Second Office Action—App 201380064132.4.

* cited by examiner

COAXIAL CABLE

CROSS REFERENCE TO RELATED APPLICATION

This application is a continuation of PCT application No. PCT/JP2013/082190, which was filed on Nov. 29, 2013 based on Japanese Patent Application (No. 2012-268213) filed on Dec. 7, 2012, the contents of which are incorporated herein by reference. Also, all the references cited herein are incorporated as a whole.

BACKGROUND

1. Technical Field

The present invention relates to a coaxial cable.

2. Description of the Related Art

In the background art, there has been proposed a coaxial cable in which an insulator, a film and an external conductor are provided in this order on the outer circumferential side of an internal conductor, and a sheath is provided on the outer circumferential side of the external conductor. In addition, there has been proposed a coaxial cable using, as an external conductor, a braid of copper wires braided like a net (hereinafter referred to as braid), a lateral coil of copper wires wound spirally (hereinafter referred to as lateral coil), or a double-layer structure in which copper or aluminum foil is wound and a braid or a lateral coil is provided on the foil (see JP-A-2012-119231 and JP-A-2012-138285).

Here, the coaxial cable according to JP-A-2012-119231 and JP-A-2012-138285 is cut in each of the aforementioned laminated layers, and work of terminal crimping or the like is performed on the layers cut thus. However, when end-portion processing is performed on the coaxial cable according to JP-A-2012-119231 and JP-A-2012-138285, there is a possibility that an uncut part left in the film or a cut part of the film may cause a failure in connection with a terminal or may cause clogging in a cutter cutting the coaxial cable.

That is, when there is an uncut part of the film in the coaxial cable according to JP-A-2012-119231 and JP-A-2012-138285, the uncut part of the film may be located on the external conductor, and an outer terminal may be connected to the external conductor in that state. In such a case, due to the film provided between the external conductor and the outer terminal, increase in contact resistance may cause a failure in connection.

In addition, a failure in connection may occur in the same manner when an inner terminal or an outer terminal is connected in the state where the cut part of the film is located on the internal conductor or the external conductor.

Further, the cut part of the film is an insulator light in weight. Therefore, the cut part adheres to the cutter easily due to static electricity. When such cut parts adhering to the cutter are put on top of each other due to static electricity, clogging may occur in the cutter.

SUMMARY

The present invention has been developed in consideration of the aforementioned situation. An object of the invention is to provide a coaxial cable capable of reducing both the possibility that a failure in connection may occur during terminal connection and the possibility that clogging may occur in a cutter.

In order to attain the foregoing object, a coaxial cable according to the invention is characterized as the following paragraphs (1) and (2).

(1) A coaxial cable including an internal conductor, an insulator that is provided at an outer circumference of the internal conductor, a film that is provided at an outer circumference of the insulator, an external conductor that is provided at an outer circumference of the film, a sheath that is provided at an outer circumference of the external conductor, and an adhesive layer that is provided between the insulator and the film and that bonds the insulator and the film with each other.

According to the coaxial cable in the aforementioned paragraph (1), due to the adhesive layer provided between the insulator and the film so as to bond the insulator and the film with each other, the film is hardly separated from the insulator. Accordingly the film hardly adheres to the internal conductor or the external conductor, and a failure in connection hardly occurs. In addition, since the film is hardly separated from the insulator, the film hardly adheres to a cutter and hardly causes clogging in the cutter. It is therefore possible to reduce both the possibility that a failure in connection may occur during terminal connection and the possibility that clogging may occur in the cutter.

(2) The coaxial cable according to the aforementioned paragraph (1), wherein the film includes an identification layer that is different in color from both the insulator and the external conductor, or the film is colored in color different from those of the insulator and the external conductor.

According to the coaxial cable in the aforementioned paragraph (2), the film includes the identification layer that is different in color from both the insulator and the external conductor, or the film is colored in color different from those of the insulator and the external conductor. It is therefore easy to confirm that the film is peeled during end-portion processing, and it is easy to visually confirm an uncut part left in the film or a cut part of the film. Accordingly, it is possible to further reduce both the possibility that a failure in connection may occur during terminal connection and the possibility that clogging may occur in the cutter.

According to the invention, it is possible to reduce both the possibility that a failure in connection may occur during terminal connection and the possibility that clogging may occur in a cutter.

DETAILED DESCRIPTION OF THE EXEMPLARY EMBODIMENTS

Figure 1A:
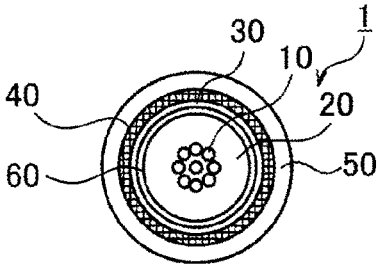
FIG. 1A and FIG. 1B are configuration views showing a coaxial cable according to an embodiment, FIG. 1A being a sectional view, FIG. 1B being a side view.
Figure 1B:
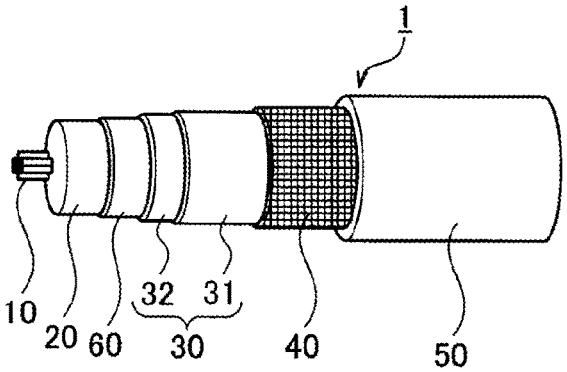

A preferred embodiment of the invention will be described below with reference to the drawings. FIG. 1A and FIG. 1B are configuration views showing a coaxial cable according to the embodiment. FIG. 1A is a sectional view, and FIG. 1B is a side view. The coaxial cable 1 shown in FIG. 1A and FIG. 1B includes an internal conductor 10 consisting of a plurality of conductors, an insulator 20 provided on the outer circumferential side of the internal conductor 10, a film 30 provided on the outer circumferential side of the insulator 20, an external conductor 40 provided on the outer circumferential side of the film 30, and a sheath 50 provided on the outer circumferential side of the external conductor 40.

For example, soft copper wires, silver-plated soft copper wires, tin-plated soft copper wires, tin-plated copper alloy wires, etc. may be used for the internal conductor 10. Incidentally, although the internal conductor 10 consists of a plurality of wires in the embodiment, the internal conductor 10 may consist of a single wire.

The insulator 20 is a member which covers the conductor 10. For example, PE (polyethylene), PP (polypropylene), or foamed PE or PP is used for the insulator 20. It is preferable that the insulator 20 has a dielectric constant not higher than 3.0.

The film 30 is a member which covers the circumference of the insulator 20. For example, PP or PET (polyethylene terephthalate) is used for the film 30.

The external conductor 40 is a member located in the circumference of the film 30. For example, a braid of soft copper wires, alloy wires, copper-coated steel wires, silver-plated soft copper wires, tin-plated soft copper wires, etc. is used as the external conductor 40.

The sheath 50 is a member provided on the outer circumference of the external conductor 40. For example, the sheath 50 consists of PE or PP in the same manner as the insulator 20. Alternatively, PVC (polyvinyl chloride) may be used for the sheath 50.

Figure 2:
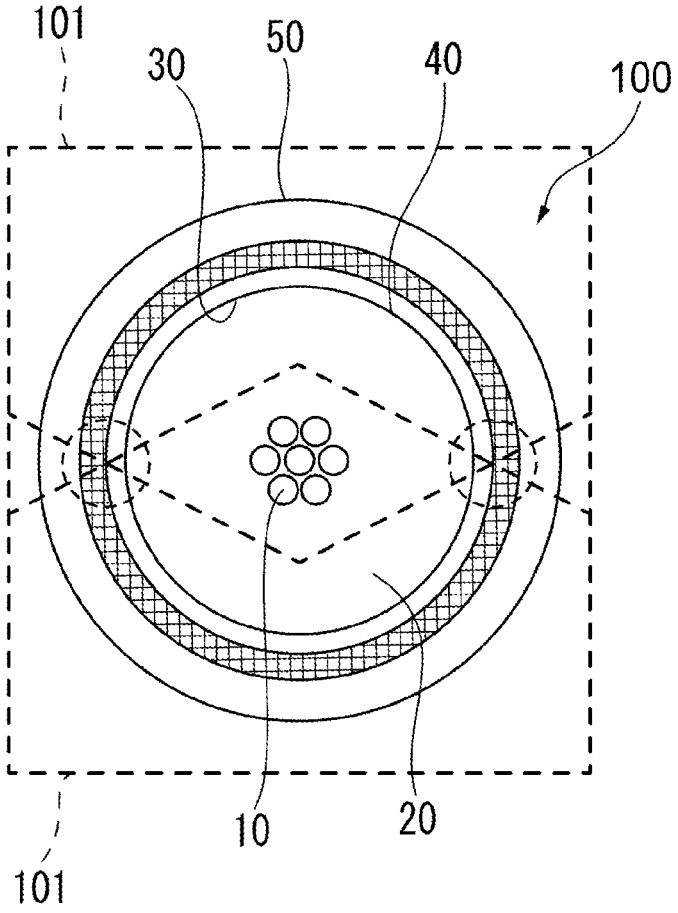
FIG. 2 is an explanatory view for explaining a state in which the end-portion processing is performed on a coaxial cable according to a first comparative example.

FIG. 2 is an explanatory view for explaining a state in which the end-portion processing is performed on a coaxial cable 100 according to a first comparative example. The end-portion processing is performed to connect a terminal to the coaxial cable 1. On this occasion, two cutting blades 101 whose tips serve as V blades (that is, V-shaped blades) as shown in FIG. 2 are used. In FIG. 2, the two cutting blades 101 are depicted by the broken lines. The two cutting blades are inserted into the coaxial cable 100 from above and from below respectively, so as to remove the members 20 to 50 on the outer circumferential side of the internal conductor 10.

However, due to the cutting blades 101 serving as the V blades, uncut parts may be left in the film 30 located at the left and right ends in FIG. 2 (that is, parts depicted by the broken-line circles in FIG. 2). This problem may arise not only when the cutting blades are V blades but also even when they are R blades (that is, R-shaped blades).

Figure 3:
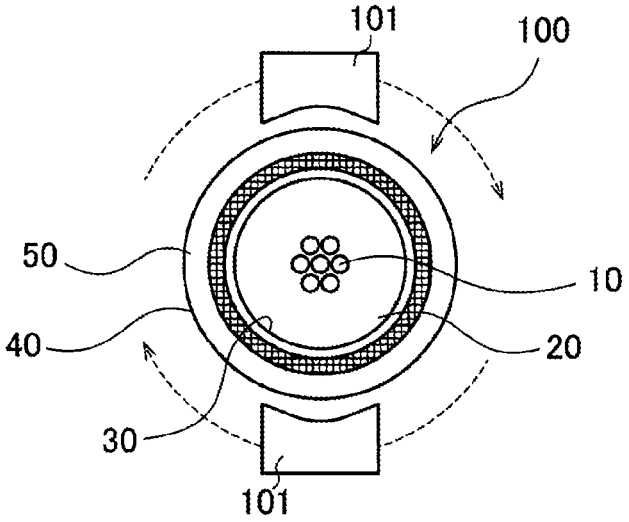
FIG. 3 is an explanatory view for explaining a state in which the end-portion processing is performed on a coaxial cable according to a second comparative example.

FIG. 3 is an explanatory view for explaining a state in which the end-portion processing is performed on a coaxial cable 100 according to a second comparative example. To cut the external conductor 40, there is another method in which the external conductor 40 is cut by two cutting blades 101 rotating along the circumference of the coaxial cable 100 as shown in FIG. 3. That is, in this example, the two cutting blades 101 rotate as shown by the broken-line arrows in FIG. 3. In the case of this method, the tips of the cutting blades 101 are designed to slightly reach the insulator 20 in order to surely cut the external conductor 40. Therefore, uncut parts may be left in the film 30.

Then, an outer terminal may be connected to the external conductor 40 in the state where an uncut part of the film 30 is located on the external conductor 40. In such a case, the film 30 is present between the external conductor 40 and the outer terminal, with the result that increases in contact resistance may cause a failure in connection.

In addition, the film 30 cut thus is typically in transparent color or the like. It is therefore difficult to visually confirm the film 30. Thus, a cut part of the film 30 may be located on the internal conductor 10 or on the external conductor 40. When an inner terminal or an outer terminal is connected in this state, a failure in connection may occur in the same manner as described above.

Further, each cut part of the film 30 is a light weight insulator, which can adhere to a cutter easily due to static electricity. When cut parts of the film 30 adhering due to static electricity are put on top of each other, clogging may occur in the cutter.

Therefore, in the coaxial cable 1 according to the embodiment, as shown in FIG. 1A and FIG. 1B, an adhesive layer 60 is provided between the insulator 20 and the film 30 so as to bond the both with each other. Due to the adhesive layer 60 provided between the insulator 20 and the film 30, the film 30 is hardly separated from the insulator 20. Therefore, the film 30 hardly adheres to the internal conductor 10 or the external conductor 40, and there hardly occurs a failure in connection. In addition, since the film 30 is hardly separated from the insulator 20, the film 30 hardly adheres to the cutter and hardly causes clogging in the cutter.

Here, it is efficient to bond the insulator 20 and the film 30 through the adhesive layer 60 using remaining heat generated by extrusion of the sheath 50 of the coaxial cable 1. For the adhesive layer 60, it is therefore preferable to use hot melt that can be welded by the remaining heat of the extrusion, such as polyester based resin, ethylene vinyl acetate based resin or the like.

In addition, the film 30 according to the embodiment has a double layer structure of a film base 31 and an identification layer 32. The film base 31 is, for example, in transparent color, and the identification layer 32 in different color from those of the insulator 20 and the external conductor 40 is applied to the inner surface of the film 30. It is therefore easy to confirm that the film 30 is peeled together with the insulator 20 during the end-portion processing. In addition, it is also possible to visually confirm an uncut part of the film 30 or a cut part of the film 30. Thus, it is possible to further reduce both the possibility that a failure in connection may occur during the terminal connection and the possibility that clogging may occur in the cutter. Incidentally, specifically the color of the identification layer 32 may be set as one of blue, orange, pink, red and green.

Next, an example of a method for manufacturing the coaxial cable 1 according to the embodiment will be described. When the coaxial cable 1 according to the embodiment is manufactured, the insulator 20 first covers the outer circumference of the internal conductor 10 by an extruder. Here, the internal conductor 10 consists of, for example, a twisted wire of seven soft copper strands each having a diameter of 0.19 mm and totally having an outer diameter of 0.54 mm. Further, crosslinked foamed PE is used for the insulator 20. The outer diameter coated with the insulator 20 reaches 1.6 mm.

Next, the adhesive layer 60 side of the film 30 coated with the identification 32 and having the adhesive layer 60 (that is, adhesive film) is pasted onto the insulator 20. At that time, the outer diameter reaches, for example, 1.7 mm.

After that, the external conductor 40 consisting of a tin-plated soft copper braid is attached onto the film 30. The external conductor 40 has a wire configuration of 0.10/5/16 in mm/wires/strands. In addition, at that time, the outer diameter reaches about 2.2 mm.

Next, the sheath 50 consisting of heat-resistant PVC covers the external conductor 40 by an extruder. On this occasion, the adhesive layer 60 melts with remaining heat generated by the extruder so as to bring the insulator 20 and the film 30 into tight contact. Incidentally, at that time, the outer diameter reaches 3.0 mm.

In the coaxial cable 1 according to the embodiment manufactured thus, the adhesive layer 60 is provided between the insulator 20 and the film 30 so as to bond the both with each other. It is therefore difficult to separate the film 30 from the insulator. Thus, the film 30 hardly adheres to the internal conductor 10 or the external conductor 40, and a failure in connection hardly occurs. In addition, since the film 30 is hardly separated from the insulator 20, the film 30 hardly adheres to the cutter and hardly causes clogging in the cutter. It is therefore possible to reduce both the possibility that a failure in connection may occur during the terminal connection and the possibility that clogging may occur in the cutter.

In addition, the film 30 is provided with the identification layer 32 different in color from both the insulator 20 and the external conductor 40, or colored in different color from those of the insulator 20 and the external conductor 40. It is therefore easy to confirm that the film 30 is peeled during the end-portion processing. In addition, it is also possible to visually confirm an uncut part of the film 30 or a cut part of the film 30. Thus, it is possible to further reduce both the possibility that a failure in connection may occur during terminal connection and the possibility that clogging may occur in the cutter.

Although the invention has been described above based on the embodiment, the invention is not limited to the embodiment, but it may be changed without departing from the gist of the invention.

For example, the coaxial cable 1 according to the embodiment is not limited to what has been described with reference to FIG. 1A and FIG. 1B, but various changes may be made thereon. For example, the internal conductor 10 does not have to consist of a stranded wire of soft copper strands, or the sheath 50 does not have to consist of heat-resistant PVC. In addition, various changes may be made on the insulator 20 or the external conductor 40 in the same manner.

Further, although hot melt is used for the adhesive layer 60 in the coaxial cable 1 according to the embodiment so as to be welded when the sheath 50 is extruded, the invention is not limited thereto. The insulator 20 and the film 30 may be bonded with each other simply by a bonding agent such as starch.

Further, although the identification layer 32 is formed by application to the film 30 in the embodiment, the invention is not limited thereto. The identification layer 32 may be formed into a sheet-like shape and pasted to the film 30. Further, the identification layer 32 may be provided outside the film 30.

In addition, in the embodiment, the coaxial cable 1 may not has the identification layer 32 and a dye may be kneaded into the film base 31 so that the film 30 itself can be colored in different color from those of the insulator 20 and the external conductor 40. In this manner, it is possible to obtain a similar effect to that in the case where the identification layer 32 is provided.

The coaxial cable according to the embodiment will be summarized below.

(1) The coaxial cable 1 according to the embodiment includes an internal conductor 10, an insulator 20 that is provided at an outer circumference of the internal conductor 10, a film 30 that is provided at an outer circumference of the insulator 20, an external conductor 40 that is provided at an outer circumference of the film 30, and a sheath 50 that is provided at an outer circumference of the external conductor 40. In addition, the coaxial cable 1 includes an adhesive layer 60 provided between the insulator 20 and the film 30 so as to bond the insulator 20 and the film 30 with each other.

(2) In the coaxial cable 1 according to the embodiment, the film 30 includes an identification layer 32 that is different in color from both the insulator 20 and the external conductor 40. Alternatively, in the coaxial cable 1 according to the embodiment, the film 30 may be colored in color different from those of the insulator 20 and the external conductor 40.

A coaxial cable according to the invention is useful because it is possible to provide a coaxial cable capable of reducing both the possibility that a failure in connection may occur during terminal connection and the possibility that clogging may occur in a cutter.

What is claimed is:

1. A coaxial cable consisting of:

an internal conductor;

an insulator that is provided at an outer circumference of the internal conductor;

a film that is provided at an outer circumference of the insulator;

an external conductor that is attached directly to an outer circumference of the film;

a sheath that is provided at an outer circumference of the external conductor; and an adhesive layer that is provided between the insulator and the film and that bonds the insulator and the film with each other, wherein, in the assembled coaxial cable:

the film consists of a double layer structure of a film base and an identification layer, the film base and the identification layer being formed of a same length in a circumferential direction of the internal conductor, the identification layer being disposed closer to the insulator in a radial direction than the film base is to the insulator, the identification layer is different in color from both the insulator and the external conductor, and the film base has a transparent color.

* * * * *